US007882968B2

(12) United States Patent
Galt et al.

(10) Patent No.: US 7,882,968 B2
(45) Date of Patent: Feb. 8, 2011

(54) DEVICE AND METHOD FOR STORING A CHILD'S POTTY SEAT

(76) Inventors: Sueann Galt, 594 Homestead La., Greenwood, IN (US) 46142; Kimberly Ann Conover Rossetti, 524 Calabria Dr., Blandon, PA (US) 19510; Frederick Michael Rossetti, 524 Calabria Dr., Blandon, PA (US) 19510

( * ) Notice: Subject to any disclaimer, the term of this patent is extended or adjusted under 35 U.S.C. 154(b) by 366 days.

(21) Appl. No.: 12/031,320

(22) Filed: Feb. 14, 2008

(65) Prior Publication Data

US 2008/0230494 A1 Sep. 25, 2008

Related U.S. Application Data

(60) Provisional application No. 60/901,520, filed on Feb. 15, 2007.

(51) Int. Cl.
*A47F 5/00* (2006.01)

(52) U.S. Cl. ..... 211/86.01; 211/119.009; 211/106.01; 248/304

(58) Field of Classification Search ..... 211/86.01, 211/13.1, 119.009, 119.004, 106.01; 4/239, 4/245.3, 300.3; 248/222.41, 225.21, 301, 248/304

See application file for complete search history.

(56) References Cited

U.S. PATENT DOCUMENTS 982,553 A * 1/1911 Wallace ..... 4/239
1,599,475 A * 9/1926 Kozminski ..... 4/248
1,605,631 A * 11/1926 Williams ..... 4/239
2,736,905 A * 3/1956 Lang ..... 4/239
2,920,853 A * 1/1960 Bufogle ..... 248/214
3,164,255 A * 1/1965 Jay ..... 211/60.1
3,170,168 A * 2/1965 Cicatello ..... 4/353
3,848,786 A * 11/1974 Baxter ..... 224/546
4,058,221 A * 11/1977 Elkins et al. ..... 211/106.01
4,137,579 A * 2/1979 Soler ..... 4/311
4,707,870 A * 11/1987 Glassco et al. ..... 4/661
5,524,295 A * 6/1996 Ford ..... 4/239
5,593,122 A * 1/1997 Robertson et al. ..... 248/222.12

FOREIGN PATENT DOCUMENTS

GB 2436332 A * 9/2007

* cited by examiner

*Primary Examiner*—Korie Chan
(74) *Attorney, Agent, or Firm*—Woodard Emhardt Moriarty McNett & Henry LLP

(57) ABSTRACT

A device and method for storing a youth potty seat on an adult toilet assembly. The device includes a support bar, a hook connected to the upper portion of the support bar, and at least one peg attached to the lower portion of the support bar. The hook is effective for hanging the support frame from the upper rim of a toilet tank, and the peg is effective for suspending a child's potty seat. The method comprises hanging the hook from the upper rim of a toilet tank and hanging a youth potty seat from the peg; thereby storing the youth potty seat on the adult toilet assembly. An extension bar may be provided to extend the length of the support bar. Multiple pegs may be used.

5 Claims, 20 Drawing Sheets

DEVICE AND METHOD FOR STORING A CHILD'S POTTY SEAT

REFERENCE TO RELATED APPLICATIONS

This application claims priority from U.S. Provisional Patent Application Ser. No. 60/901,520, filed Feb. 15, 2007, the entire contents of which are incorporated herein by reference.

FIELD OF THE INVENTION

The present invention relates generally a method and device for storing a child's potty seat, and more particularly to a method and device for storing a child's potty seat on or adjacent to a toilet tank.

BACKGROUND OF THE INVENTION

Parents often potty train their children using a child-sized training seat sized to fit over a normal toilet seat. The child's seat rests on top of the adult stool when in use to provide a child-sized seat that is comfortable for children and is small enough to prevent the child from falling through the opening in the seat. To allow adults also to use the toilet, the child's seat is usually removed when not in use.

Storage of the child's seat when not in use can be problematic. Often, the child's potty seat is placed on bathroom floors or on trashcans. Storage in these places can infect the potty seat with bacteria or viruses from the floor and trashcan. Moreover, the potty seat itself may infect the storage areas, particularly when boys or girls accidentally splash urine on the potty seat. (Some seats actually include a splashguard for boys, and the splashguard is expected to become splattered with urine.) Small children using a potty seat may not have the motor skills or dedication to clean the seat before storing it, and adults may not make the effort to clean drops of urine off before storing the seat.

Hanging hooks are known to be used for storage. These hooks offer an alternative to putting hooks in drywall or using unsightly, unsafe nails. These storage hooks may be of various lengths, and typically hang over-the-door. They hold a variety of items, such as clothes hangers, shoes, or wreaths.

There are also short hanging devices that allow items such as toilet wands with disposable cleaning heads to be hung from the toilet tank. None of these devices are effective for storing a potty seat, and none of these devices prevents urine drips on the bathroom areas mentioned above.

A need therefore exists for a storage device for storing a potty seat in a bathroom, preferably while also solving the problem of unwanted urine drips. The present invention addresses that need.

SUMMARY OF THE INVENTION

Briefly describing one aspect of the present invention, there is provided a device and method for storing a youth potty seat on an adult toilet assembly. The device comprises a support member, a hook connected to the upper portion of the support member, and at least one peg attached to the lower portion of the support member. The hook is effective for hanging the support frame from the upper rim of a toilet tank, and the peg is effective for suspending a child's potty seat. The method comprises hanging the hook from the upper rim of a toilet tank and hanging a youth potty seat from the peg; thereby storing the youth potty seat on the adult toilet assembly.

An extension bar may be provided to extend the length of the support member. Multiple pegs may be used.

DETAILED DESCRIPTION OF THE PREFERRED EMBODIMENTS

Figure 1:
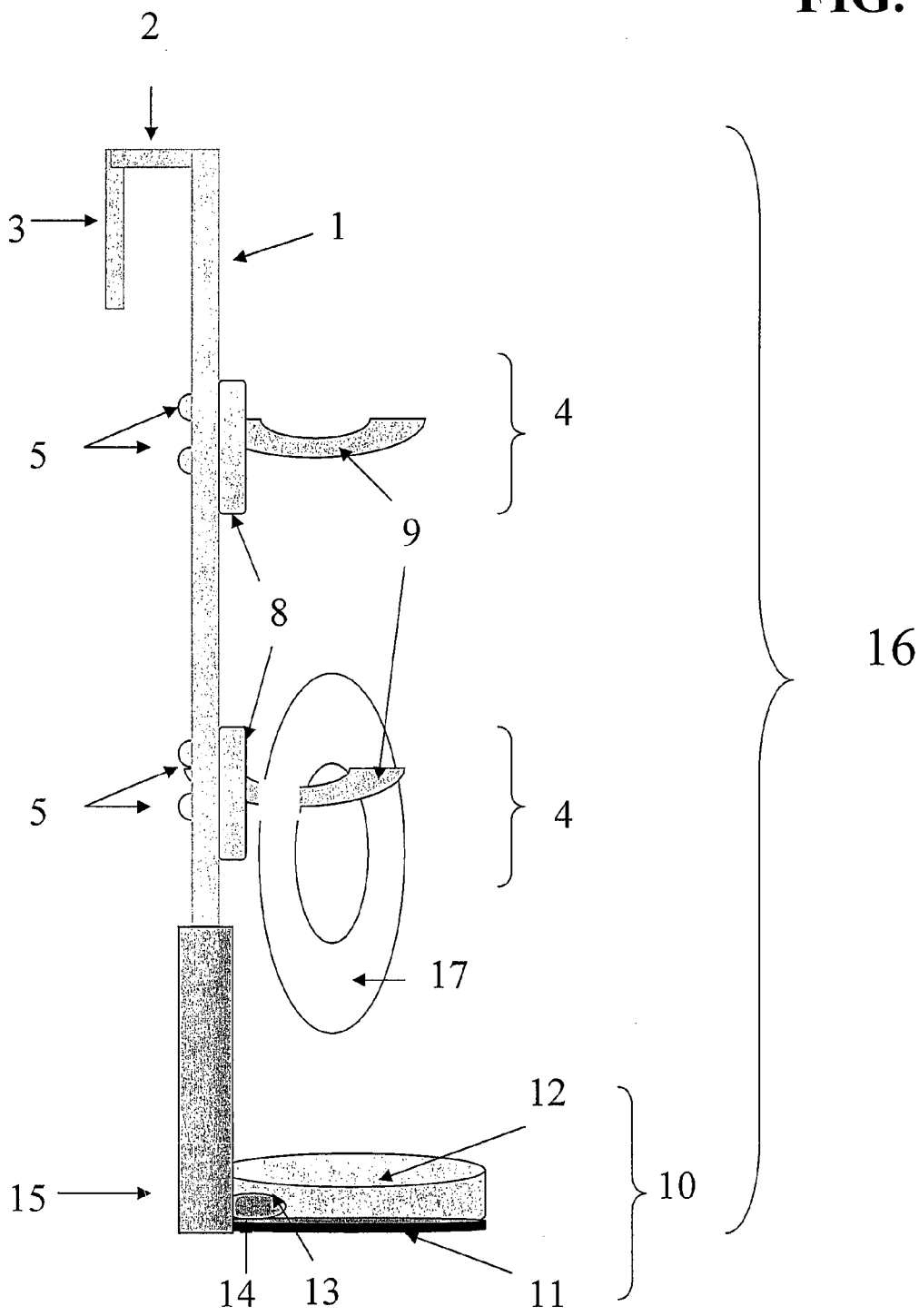
FIG. 1 is a side view of one embodiment of the device of the present invention.

For the purposes of promoting an understanding of the principles of the invention, reference will now be made to certain preferred embodiments and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

As indicated above, one aspect of the present invention relates to a device and method for storing a youth potty seat on an adult toilet assembly. The device comprises a support member, a hook connected to the upper portion of the support member, and at least one peg attached to the lower portion of the support member. The hook is adapted to hang the support frame from the upper rim of a toilet tank, and the peg is adapted to hold a child's potty seat. The method comprises hanging the device by its hook from the upper rim of a toilet tank and hanging a youth potty seat from the peg, thereby storing the youth potty seat on the adult toilet assembly.

Describing the device in greater detail, the storage rack of the present invention is effective for holding and storing a youth potty seat. In one embodiment the storage rack attaches to a toilet tank to store a youth potty seat at the toilet. In another embodiment the storage rack uses a floor support to hold the rack next to the toilet or in another convenient place.

A potty support peg is preferably used to hold the potty seat for storage. Multiple pegs may be used to store one or multiple potty seats. The peg(s) are preferably attached to a support frame, and may be removable from the frame. In one embodiment the peg(s) is removably attached to the frame by studs that cooperate with apertures in the frame. Each peg is sized to hold a potty seat, and is preferably between about 3 and 6 inches in length. Pegs are made of a material and in a manner effective to support the weight of a potty seat when stored on the frame. Plastic pegs having a length of about three to four inches, a height of about one inch, and a width of about ½ inch to one inch are particularly preferred.

In one embodiment the support frame includes a hook at one end to facilitate hanging the frame from a toilet tank. Such a frame is typically 6 to 12 inches in length, although shorter or longer frames may be used. The hook is preferably flat enough in all relevant dimensions to hook easily over a toilet tank when the tank lid is in place.

An extension bar may be provided with the frame when it is desired to optionally extend the frame beyond its base length. Such extension bars typically extend the frame by 12 to 18 inches, although a shorter or longer extension may be provided. The extension bar may mount to the frame, for example, with studs that cooperate with apertures in the frame, or with apertures that cooperate with studs on the frame. Alternative means of attachment may be used.

In another embodiment of the present invention the support frame is mounted to a standing bar to allow the device to stand without being hooked to a toilet tank. The standing bar may include a "saucer" area to accept urine or other waste that may drip from the potty seat during storage on the device.

The size of the device may be varied according to the needs of a particular user, but the device is preferably small enough to accommodate the small space of a bathroom, yet large enough to hold a youth potty seat. The device may be adapted to use little or no floor space, as when the device is hung from a toilet tank. Alternatively, the device may be hung from a wall or other surface.

The device of the present invention may be made of plastic, wood, metal, or any substance sturdy enough to hang, stand, or hold objects on hooks. The device may be designed to match existing bathroom décor, including but not limited to children's trademarked designs. The device may be antimicrobial or possess similar properties to make it easy to clean and sanitize. It may be dishwasher safe.

As to the method of use, when a child is finished using the potty seat he or she may remove it from the adult stool and hang it on the device of the present invention. As previously described, the potty seat may be hung in a way so that urine drips may be collected on a saucer or tray. Multiple potty seats may be hung from the device to accommodate multiple children, each with his/her own seat.

When potty training is over and the potty seat is no longer used, this invention may hold a variety of other items. Any item with a large hanging hole can be placed on the existing hooks. Dozens of items such as toilet paper could be placed in the floor tray for off-the-floor storage. Accessory hooks, trays, or devices compatible with the invention may be used to hold toilet paper, wipes, pot pourri, items with small holes for hanging, or other items. As this invention can possibly standalone, the uses are not limited to the bathroom.

Figure 2:
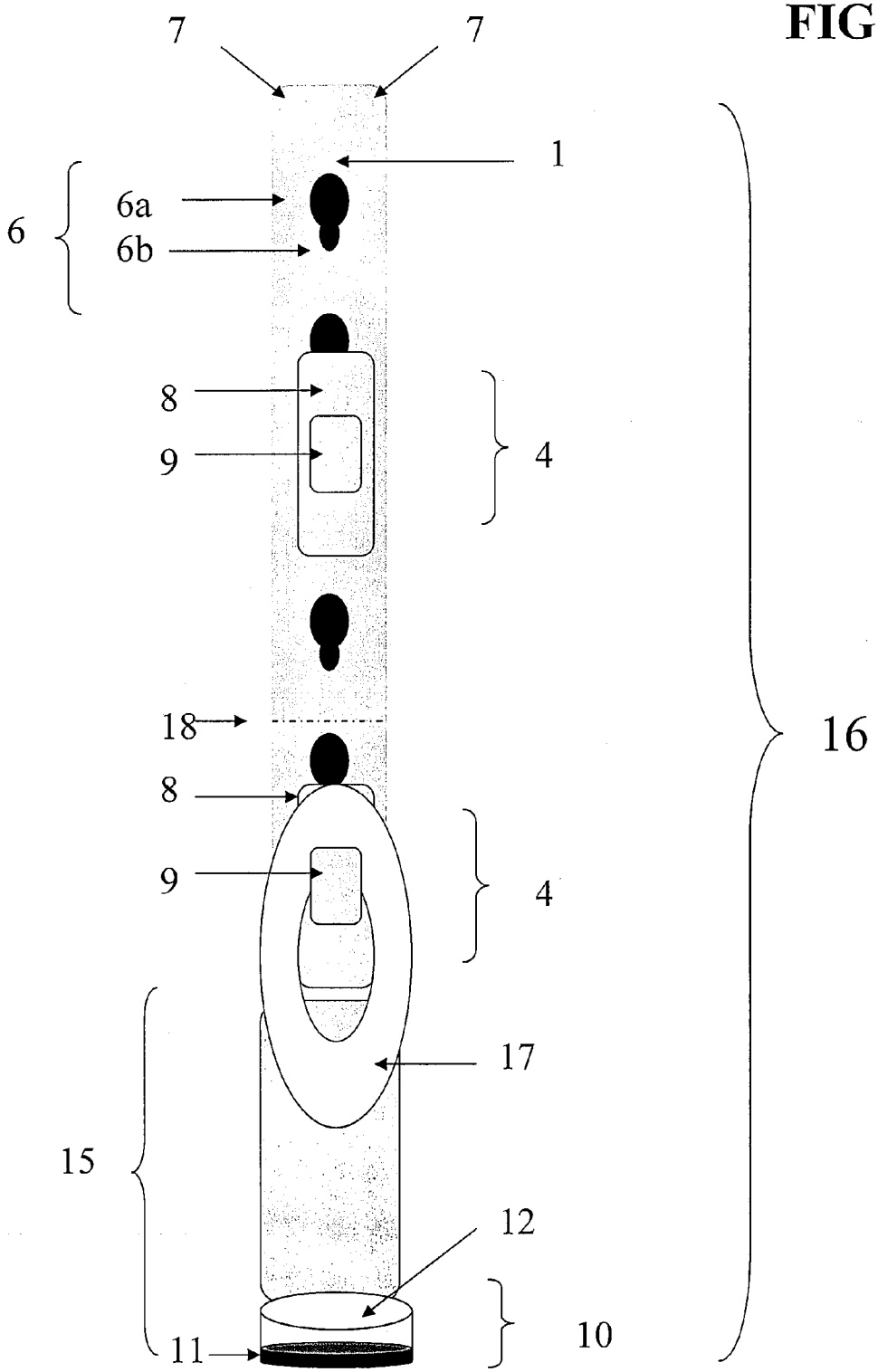
FIG. 2 is a front view of the embodiment of FIG. 1.

Referring now to the drawings, FIG. 1 is a side view of the device according of one embodiment of the present invention. Device 16 is illustrated as a stand-alone storage device in use, depicting a potty seat 17 hanging from potty peg 4. Support bar 1 connects to standing bar 15, and standing bar 15 connects to floor tray 10. Knob 14 on standing bar 15 fits in opening 13 on the floor tray 10. Two potty pegs 4 are connected to support bar 1 via studs 5. Potty peg 4 may include the following components: peg studs 5, base portion 8, and peg portion 9, as further described in FIG. 6. Peg studs 5 lock securely into keyholes 6 (keyholes 6 are depicted in FIG. 2). Floor tray 10 may be the base on which the device 16 maintains balance if used as a stand-alone device. Hook portions 2 and 3 need not be used when the device is used as a free standing unit.

The length, width, height, and material of each individual element of device 16 may be determined by the strength needed to make the device function as stand-alone and sanitary unit. Floor tray 10 may include a non-skid bottom 11. The angle of peg 9 and floor tray 10 may be designed to help balance the device 16. All portions of the device 16 may have an anti-microbial or like coating for easy cleaning and sanitizing. Although not depicted in all drawings, all portions of device 16 may have rounded corners 7 for safety, as depicted in FIG. 2.

FIG. 2 shows a front view of the stand-alone storage device of FIG. 1. Several keyholes 6 line support bar 1 to hang potty pegs 4 at various heights. Keyholes 6 may go completely through support bar 1 and standing bar 15. Keyholes 6 are large at the top 6*a* for peg studs 5 to penetrate. The keyholes 6 are small at the bottom 6*b* for peg studs 5 to snap securely into place. Peg studs 5 may penetrate the keyholes 6 and provide support on the back of the device 16 as shown in FIG. 1. As previously indicated, the edges of device 16 may be rounded for safety as depicted by rounded corners 7. The device may include a fold 18 to facilitate storage of the device when not in use. Fold 18 may be anywhere on the device 16, not necessarily along the middle of support bar 1.

Figure 3:
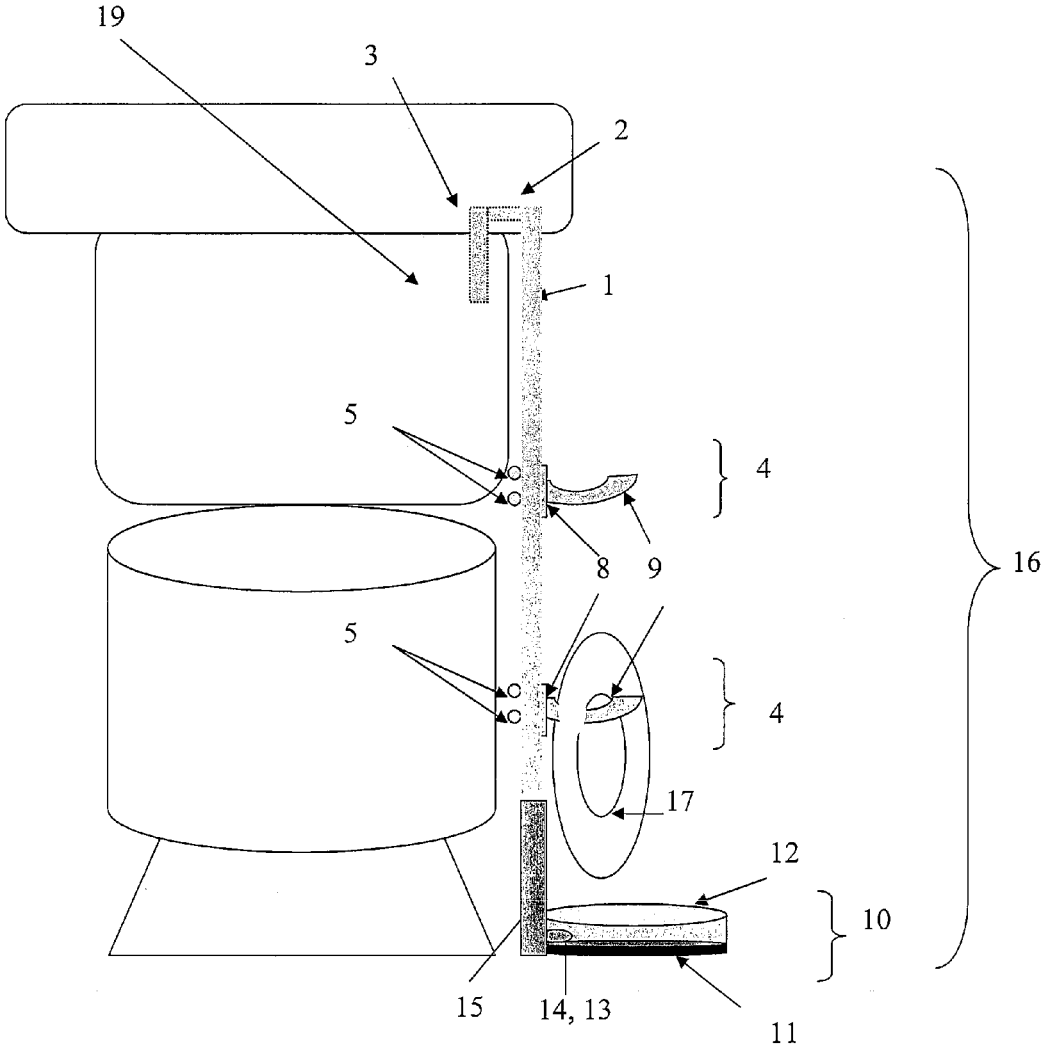
FIG. 3 is a side view of the embodiment of FIG. 1 attached to a toilet tank, with the floor tray attached to the device.
Figure 4:
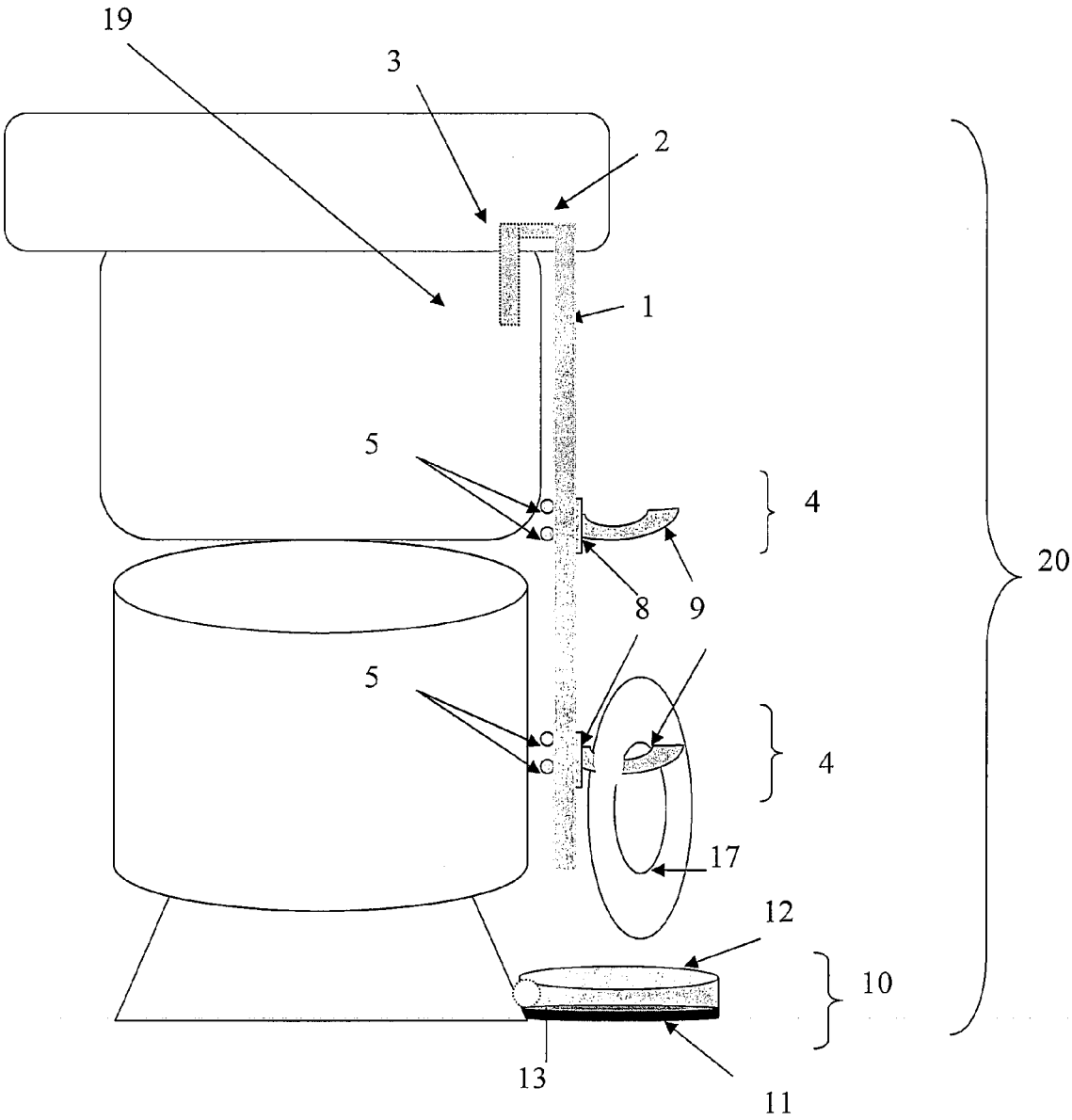
FIG. 4 is a side view of the embodiment of FIG. 1 with the floor tray in use but unattached.

FIG. 3 shows a side view of device 16 when hanging from a toilet tank and while connected to the floor tray. A potty seat 17 is hanging from potty peg 4. Device 16 is shown hanging from the side of a toilet tank via hanging hook members 2 and 3. The standing bar 15 and floor tray 10 are attached to keep the floor tray 12 positioned to receive waste from a potty seat during storage on the device. The support bar 1 may simply hang via hook portions 2 and 3 as shown in FIG. 4.

In the illustrated embodiment support bar 1 slides into standing bar 15. Standing bar 15 connects to the floor tray 10 as knob 14 fits in opening 13. Two potty pegs 4 are connected to support bar 1 via peg studs 5. Peg studs 5 lock securely into keyholes 6, as shown in FIG. 2. Although floor tray 10 may be connected to the support bar 1 via standing bar 17, it is not necessarily being used as support.

The length of support bar 1 joined with the standing bar 15 may be adjustable in order to accommodate most toilet heights. Standing bar 15 may slide over support bar 1 as far as necessary for device 16 to hang from the toilet tank and also reach the floor. Hanging hook portions 2 and 3 are sturdy enough to hold the support bar 1 and potty pegs 4 with one ounce to ten pounds of items even without the aid of the standing bar 15 and/or floor tray 10, as shown in FIG. 4.

Figure 8:
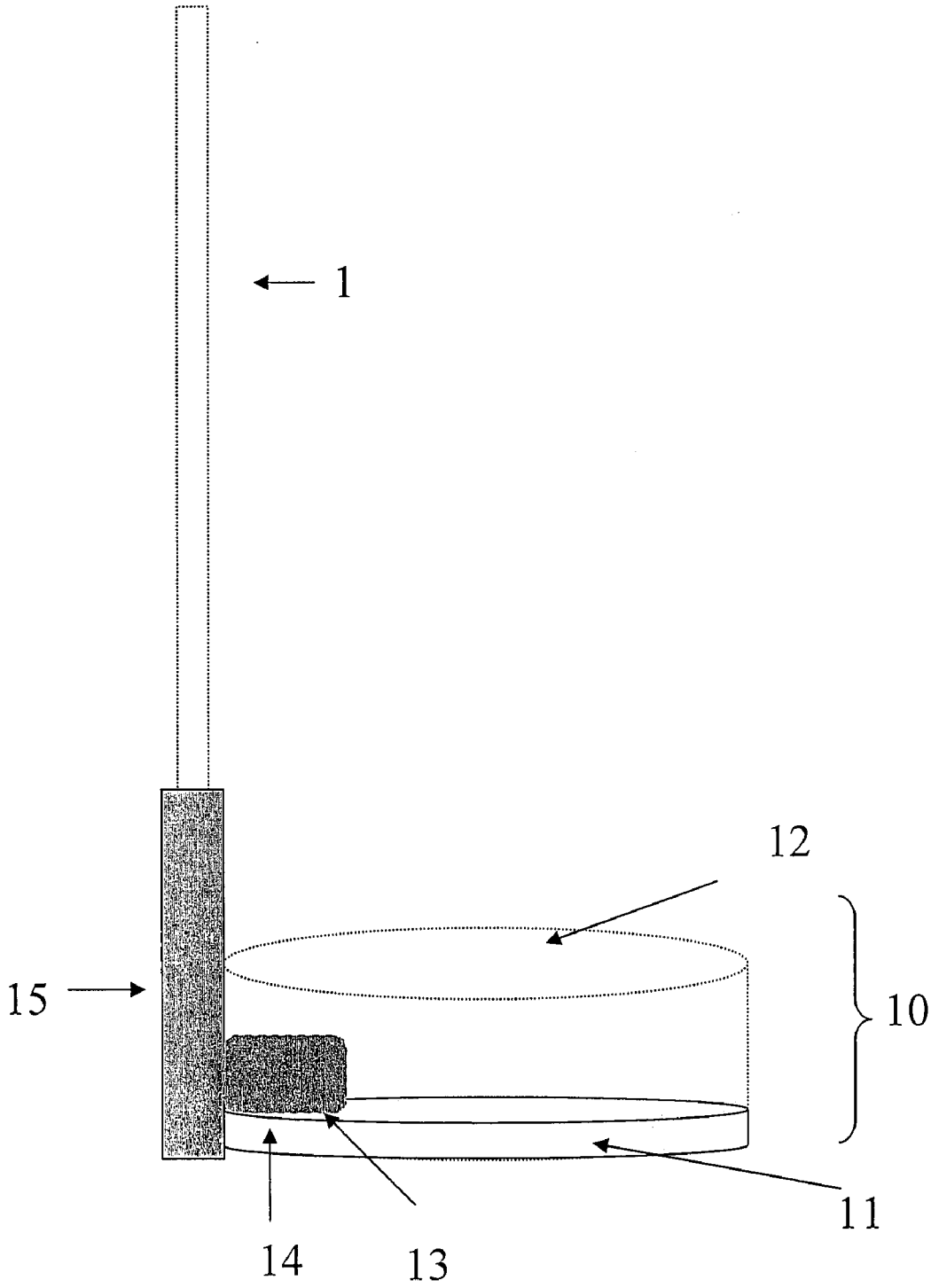
FIG. 8 is a side view of one embodiment of an extension bar that may be used in some embodiments of the present invention.

Support bar 1 and standing bar 15 may simply hang from toilet tank 19 or like object using hook members 2 and 3, and may be used without the support of floor tray 10. In this case a locking hook or peg may be used to connect the support bar 1 and standing bar 15, as shown in FIG. 8. This same locking hook or peg could be used if the user desired the entire device 16 to be hanging storage but not touch the floor.

FIG. 4 shows a side view of the device of FIGS. 1-3, with floor tray 10 unattached. In this embodiment support bar 1 may be utilized to store potty seats by hanging hook portions 2 and 3 over the rim of a toilet tank, and floor tray 10 may still be used to collect waste. This alternative embodiment 20 may offer a more sanitary place to store the potty seat than the wall, floor, or trashcan.

Hanging hook portions 2 and 3 may attach support bar 1 to the toilet tank 19 or other thin object such as a cabinet door or drawer. The pegs 4 may attach securely into keyholes 6 (shown in FIG. 2) but may be removable and repositionable as needed. Peg studs 5 of pegs 4 securely connect to support bar 1. The keyholes 6 completely penetrate the support bar 1 (shown in FIG. 2 and FIG. 5). Peg studs 5 lock into the bottom portion of keyholes 6 and provide support on the backside of the support bar 1.

Figure 5:
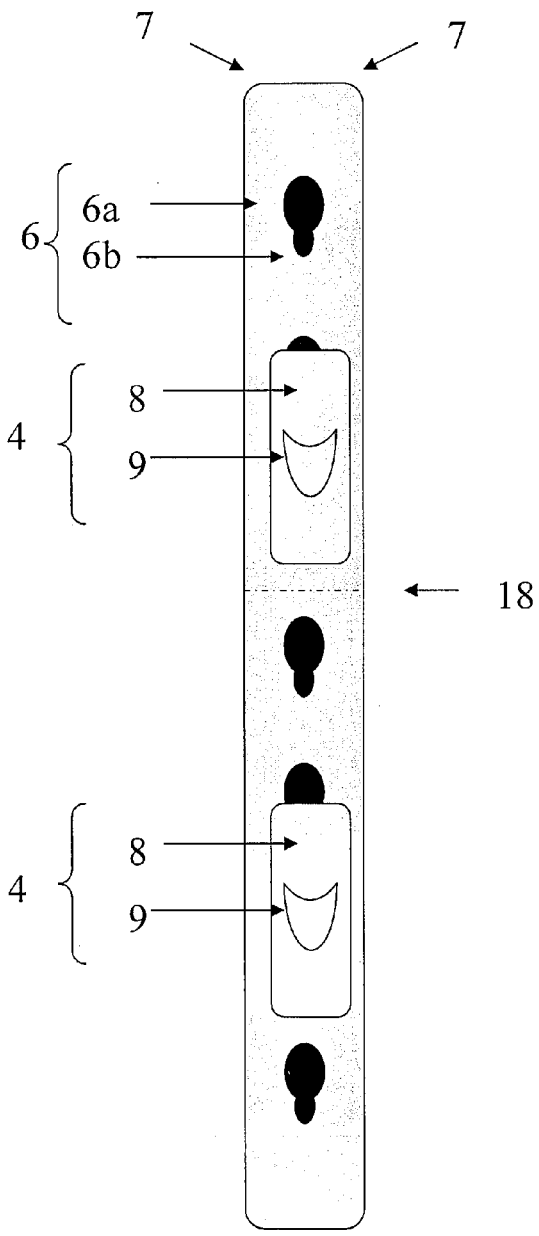
FIGS. 5 and 5*a* are front views of one embodiment of the hanging bar that may be used in some embodiments of the present invention, with hooks attached in FIG. 5 and without hooks attached in FIG. 5*a*.

In the illustrated embodiment the support bar 1 is preferably between 12" and 20" long, most preferably about 16". Support bar 1 is preferably sturdy enough to hold one-to-five pounds of objects on each of pegs 4. The support bar 1 of the illustrated embodiment is preferably ¼"-¾" thick, and is sturdy enough to stand alone and hold one-to-ten pounds of objects. Support bar 1 is preferably between 1" and 2" wide, as shown in FIG. 5. Hanging hook portions 2 and 3 may securely attach support bar 1 to the toilet tank 19 or other thin object such as a cabinet door or drawer. Hanging hook portions 2 and 3 are preferably about the same width as the front face of the support bar 1, approximately 1"-2". Hanging hook portion 2 may be thin and short enough to fit in the area between the toilet tank and the lid. Hook member portion 2 may be approximately ¼" thick and ¾" long. Hanging hook portion 3 may be thick and long enough to provide support for support bar 1, and is preferably between ¼"-¾" thick and 1"-3" long.

Pegs 4 may attach securely into keyholes 6 (shown in FIG. 2) using peg studs 5, but may be removable and repositionable as needed Attachments may be created to suction to the toilet tank 19 and attach to the support bar 1 to keep the hanging bar vertical. If not attached to the standing bar 15, the floor tray 10 may still be positioned anywhere under the support bar 1. In this case, the floor tray 10 may be designed to catch drips of urine, not provide support or balance. If the invention is being used to hold items other than potty seats, the floor tray 10 may be used for storage of wipes, pot pourri, toilet paper, or other items.

FIG. 5 is the front view of support bar 1 depicted in FIG. 4. Keyholes 6 may go completely through support bar 1. Keyholes 6 line support bar 1 to allow pegs 4 to be placed at various heights. Keyholes 6 are large at the top 6*a* for peg studs 5 to enter. The keyholes 6 are small at the bottom 6*b* for the peg studs 5 to snap securely into place. Peg studs 5 from FIG. 1 may penetrate the keyholes 6 and provide support on the back of the device 16/20. Corners 7 are rounded for safety.

Figure 5A:
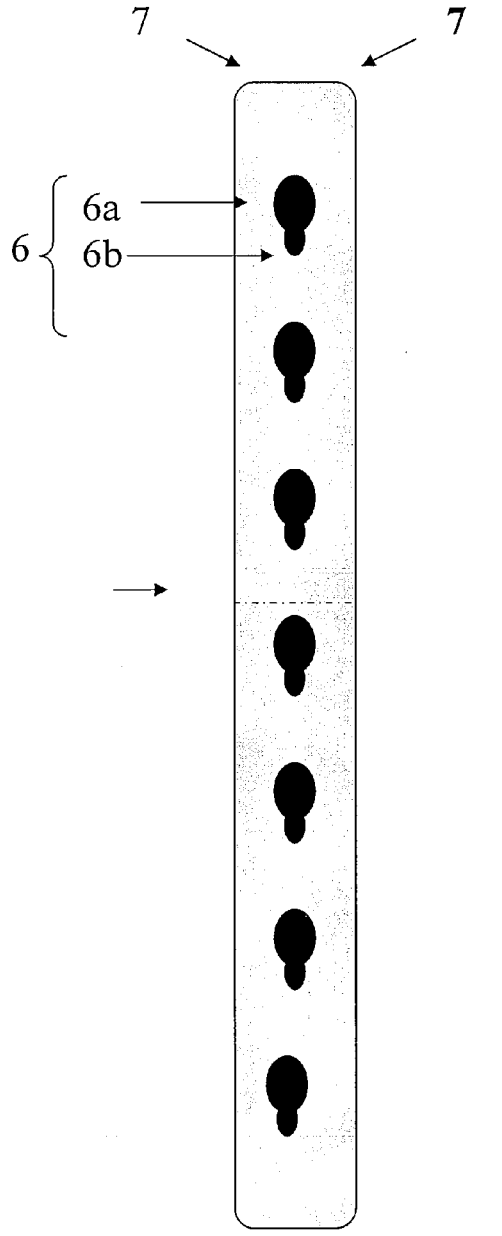

The number of keyholes 6 is preferably between six and twelve, most preferably about eight, in order to provide a variety of heights on which to hang pegs 4. Spacing of the keyholes 6 depends on the design of peg 4 and on the spacing needed for maximum support, most likely ½"-¾" apart. Keyholes 6 may be designed for maximum support and compatibility with peg studs 5, preferably utilizing portions 6*a* and 6*b*. Keyholes 6 are large at the top 6*a* for peg studs 5 to enter, and are small at the bottom 6*b* for the peg studs 5 to snap securely into place. Peg studs 5 in keyhole portion 6*b* may be removable if peg 4 is pushed towards the large portion 6*a*. Keyholes 6 may be rounded or of a different shape to provide optimal support of pegs 4. Support bar 1 may or may not fold near area 18 for storage or commercial packaging FIG. 5*a* is another view of the support bar 1 of FIG. 5, with the pegs 4 removed.

Figure 6:
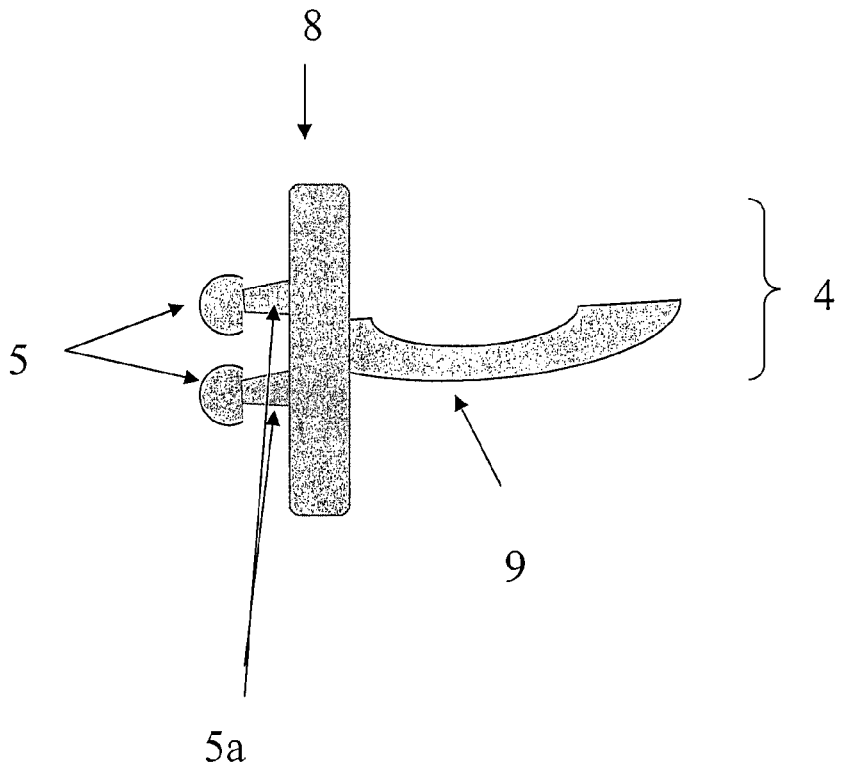
FIG. 6 is a side view of one embodiment of the movable peg that may be used in some embodiments of the present invention.

FIG. 6 illustrates certain details of potty peg 4. Peg 4 may comprise peg portion 9, base portion 8, and peg studs 5 having peg stud shanks 5*a*. One or more pegs 4 may be attached to support bar 1 to store items, specifically a child's potty seat. Two peg studs 5*a* may lock into keyholes 6 (shown in FIG. 5) to secure the hook in place. Peg studs 5 may provide support for the hanging object on the backside of support bar 1, and base portion 8 may provide support in the front. Base portion 8 holds peg 9. Peg portion 9 may be designed to prevent hanging objects from falling off.

Peg 4 may include one or two or more peg studs 5, although two peg studs is preferred to balance support with ease of use. The length, height, width, weight, and shape of peg studs 5 and base portion 8 may be determined by the strength necessary to make the device 16 stand alone as depicted in FIG. 1 and FIG. 2. In one preferred embodiment peg studs 5 have a half-circle shape at the end to lay flush and provide support against the back of support bar 1.

The distance between the two peg studs 5 on hook 4 may be determined by the strength needed to hold an ounce-to-several pound object. Peg 9 may be thick enough and long enough to hold an ounce-to-several pound object. Possible peg 9 thickness to hold a potty seat may be ¼"-¾" wide and 3"-6" long. Peg portion 9 may be perpendicular to the hanging bar in FIG. 4 or slightly angled upwards so a hanging object will not fall off. Peg portion 9 may be larger and thicker at the end farthest from the base to create a peg shape. A peg end would preventing most hanging objects from falling off, although a slight angle up or valley in the peg (as shown in peg 9 of FIG. 6) may be sufficient. The peg 9 and base portion 8 shapes will prevent the potty seat 17 from leaning towards the support bar 1 and dripping urine on it. Peg 9 could be various lengths and shapes to hold a variety of objects.

Different hooks may be created to be compatible with the keyholes 6. These hooks may be of any shape or material needed to hold toilet paper, wipes, pot pourri, objects with small hanger holes, etc. This device 16 (FIG. 1) and 20 (FIG. 4) can be a usable storage rack even if there is no potty seat to hang.

Figure 7:
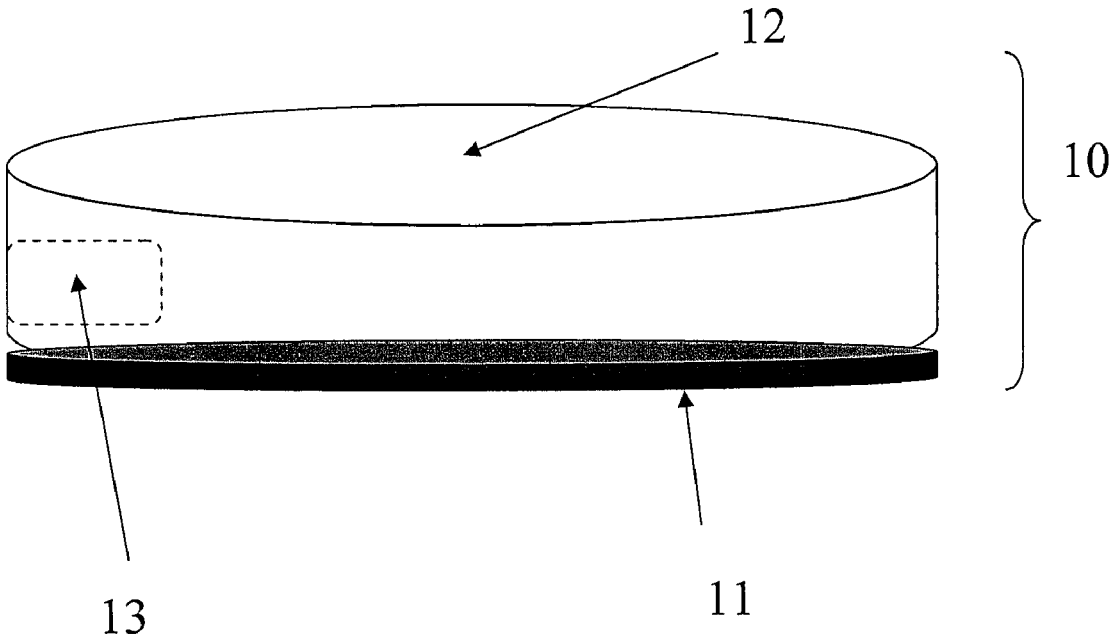
FIG. 7 is a perspective view of one embodiment of the non-skid floor tray that may be used in some embodiments of the present invention.

FIG. 7 shows one embodiment of non-skid floor tray 10. Floor tray 10 may specifically be designed to catch urine drips from hanging potty seats. It also may be a support base when the device 16 is used as a stand-alone device as shown in FIG. 1. If not attached to the support bar 1 via the standing bar 15, the floor tray 10 may be placed on the floor directly under the object hanging on support bar 1. Saucer area 12 will collect urine and is easy to wipe clean. Non-skid surface 11 prevents floor tray 10 from being easily displaced. Opening 13 may house knob 14 depicted in FIG. 8 to allow the entire apparatus to be a stand-alone device if desired.

Floor tray 10 can be a variety of lengths, including 5"-12" long and 4"-8" wide. To best collect drips and provide support the tray is preferably about 6" long and 4" wide. The weight of the floor tray 10 may depend on the weight needed to provide support for the support bar 1 as a stand-alone storage rack (as seen in FIG. 1) with up to ten pounds on it.

Floor tray 10 preferably does not have sharp corners so the product may be safe and easy to clean. The saucer area 12 may or may not be deep, as urine drips are minimal. Saucer area 12 may be curved with no corners so it may be easy to clean. If urine drips are not a concern, floor tray 10 may be used as-is or modified for off-the-floor storage. Opening 13 may be large enough to support the support bar 1 and standing bar 15 in FIG. 1 as a stand-alone device with hanging objects. Non-skid surface 11 may be of a different material than the rest of the tray. Preferably it is plastic with a non-skid texture, but it might also have suction cups, or Velcro for carpets, Non-skid surface 11 may also be treated with anti-microbial material if possible to keep the invention easy to clean and sanitize.

Floor tray 10 may be one piece or multiple pieces. The saucer area 12 may or may not be removable from the remainder of the floor tray 10 for easy cleaning. Knob 14 may be put into or removed from opening 13 as needed.

FIG. 8 shows a side view of standing bar 15. Standing bar 15 may be used to connect the floor tray 10 to support bar 1. In the illustrated embodiment standing bar 15 has knob 14 to fit in the opening 13 of floor tray 10 depicted.

Figure 10:
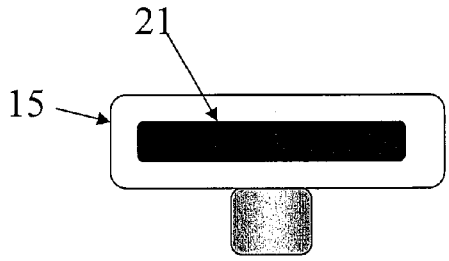
FIGS. 10 and 10*a* are top views in cross section of the extension bars of FIGS. 9 and 9*a*, respectively.

Knob 14 may be large enough to support the entire device 16 as a stand-alone device shown in FIG. 1. Knob 14 and opening 13 may be rounded or of another shape in order for knob 14 to be removable from opening 13 as needed. Standing bar 15 and knob 14 may be one piece, or it may be more than one if needed to act as removable support in opening 13. Standing bar 15 may be hollow and fit like a sheath around support bar 1 as depicted in FIG. 10. Standing bar 15 may be as long as needed to provide support for the device 16 as a freestanding device.

Figure 9:
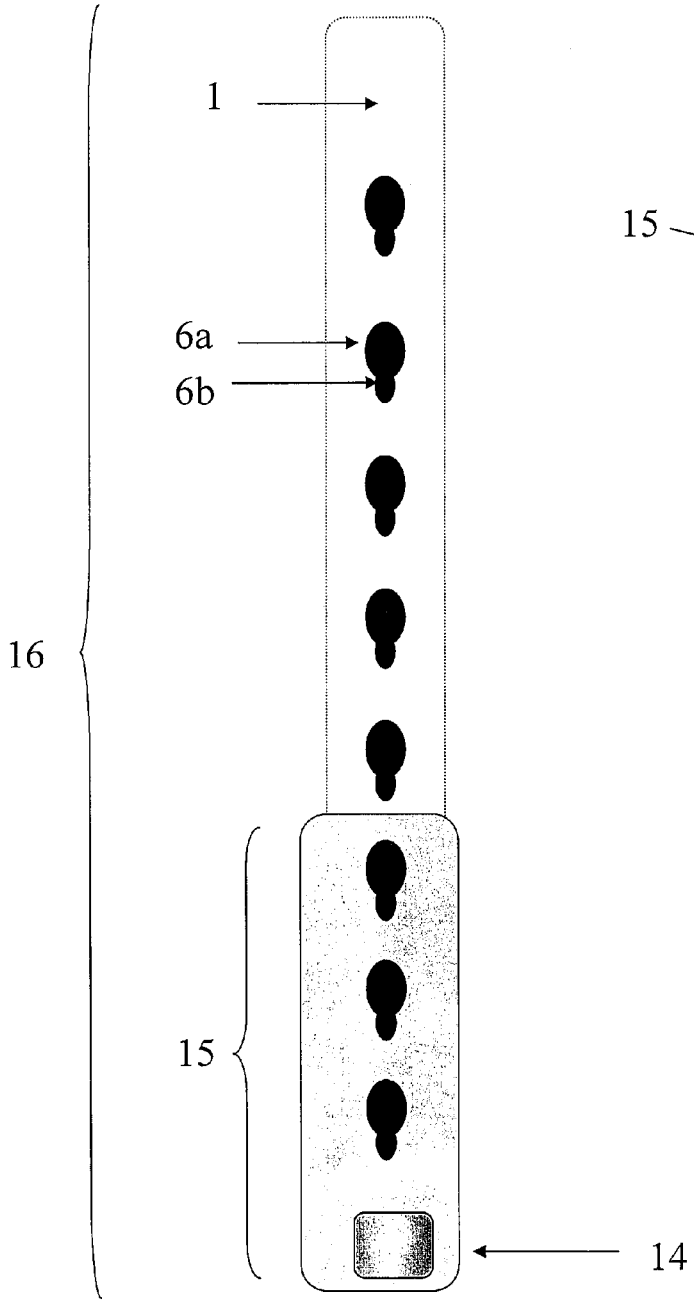
FIGS. 9 and 9*a* are front views of alternative embodiments of extension bars that may be used in some embodiments of the present invention.

FIG. 9 shows a front view of standing bar 15 of FIG. 8. Standing bar 15 may connect to support bar 1 to create a strong, freestanding storage device 16 (possibly similar to an adjustable curtain rod). The sheath method will allow the user to create a custom height for the invention that will reach from toilet tank to floor. Keyholes 6 in support bar 1 are also found in standing bar 15. When support bar 1 is inside standing bar 15, keyholes 6 can match up so peg studs 5 may penetrate both objects. Peg stud 5 penetration is depicted in FIG. 1.

Standing bar 15 has knob 14 to fit in the opening 13 of floor tray 10 depicted in FIG. 7. Standing bar 15 is preferably between 4" and 20" long. The height and thickness of standing bar 15 may be determined by the strength needed for the invention to stand-alone as shown in FIG. 1. The keyhole 6 properties of the standing bar 15 may be the same as the keyhole 6 properties of support bar 1. Peg studs 5 used when the support bar 1 is in the standing bar 15 may be different because parts 5*a* in FIG. 6 must be long to go through both items. The number of keyholes 6 on the standing bar 15 will depend on the length of the standing bar 15. The standing bar 15 may simply cover the sides of the support bar 1 and not cover the keyholes 6. This would still provide support for the support bar 1 but not interfere with existing keyholes 6 or require different peg studs 5*a*. This is depicted in FIG. 9*a*.

Figure 9A:
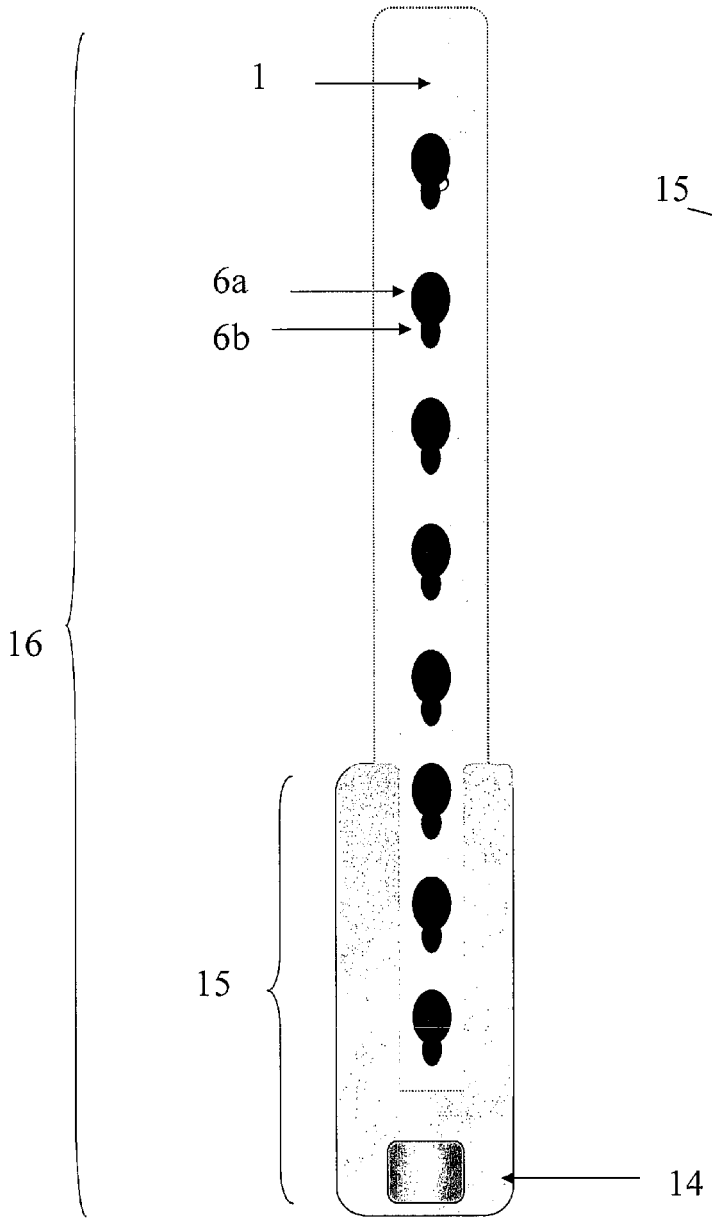

FIG. 9*a* shows an embodiment of standing bar 15 in which the bar covers the sides of the support bar 1 without covering the keyholes 6. This still provides support for the support bar 1 but not interfere with existing keyholes 6. This scenario would not require different peg studs 5*a* as depicted in FIG. 6.

FIG. 10 shows the cross section of the standing bar 15 of FIG. 8. The standing bar 15 may fit around the support bar 1 of FIG. 4 and FIG. 5 like a snug sheath. Item 21 is the hole in which the hanging bar would sit. All dimensions of the standing bar 15 may be determined by the strength needed for the invention to stand-alone as shown in FIG. 1.

Figure 10A:
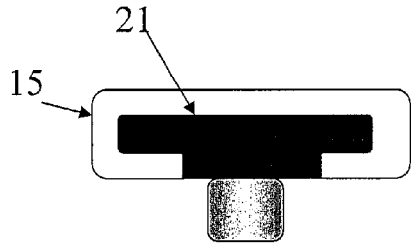

FIG. 10*a* is the cross section of the standing bar 15 of FIG. 8, with possible configuration 9*a*.

Figure 11:
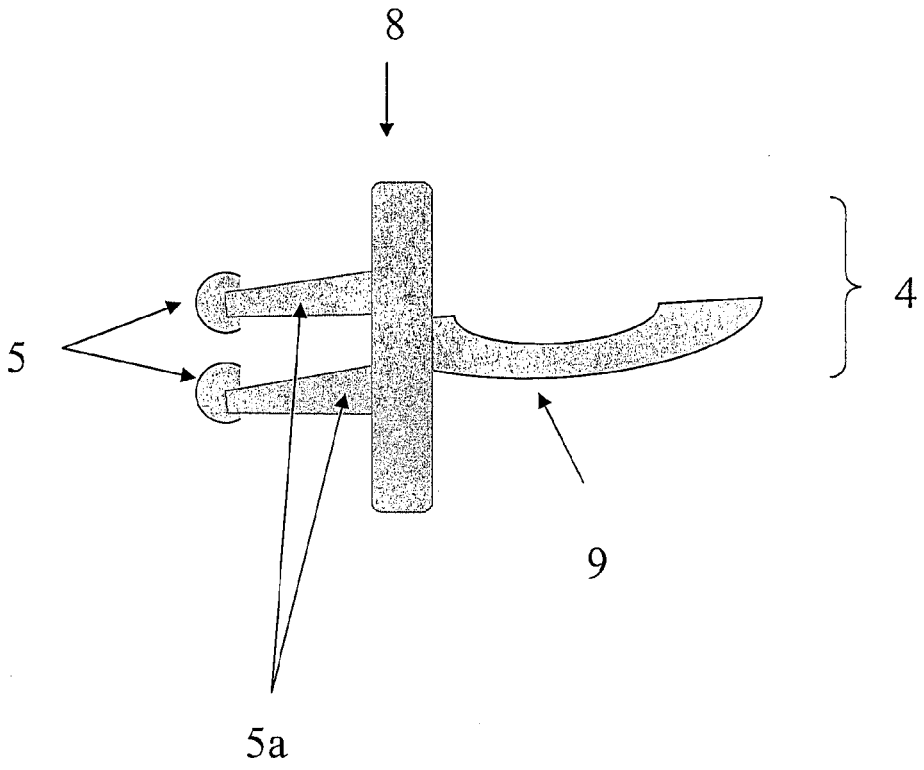
FIG. 11 is a side view of another embodiment of the movable peg that may be used in some embodiments of the present invention.

FIG. 11 shows another embodiment of peg assembly 4 with modified peg studs 5*a* to fit through both the support bar 1 and standing bar 15. Peg studs 5*a* dimensions may be determined by the strength needed for the device 16 to be stand-alone as shown in FIG. 1. This modified peg stud 5*a* may not be needed if configurationsx are used as in FIG. 9*a* and FIG. 10*a*.

Accessories may be created to be compatible with device 16. Accessories may have an anti-microbial or like coating for easy cleaning and sanitizing. Accessories may have rounded corners for safety.

In one aspect of the invention the device includes only support bar 1 and pegs 4, as seen in FIG. 4. Other items may be purchased separately such as the floor tray 10 and standing bar 15. Examples of accessories include but are not limited to:

1. A large tray designed to attach and sit on top of the stand-alone storage device in FIG. 1. The large tray may attach to the hanging hook portions 2 and/or 3;
2. A toilet paper holder compatible with the hanging bar in FIG. 4 and FIG. 5;
3. A holder for reading material;
4. A holder for wipes;
5. Hooks or designs on the invention may to match adult or children's bathroom décor;
6. A bag to store extra parts when not in use.

Figure 12:
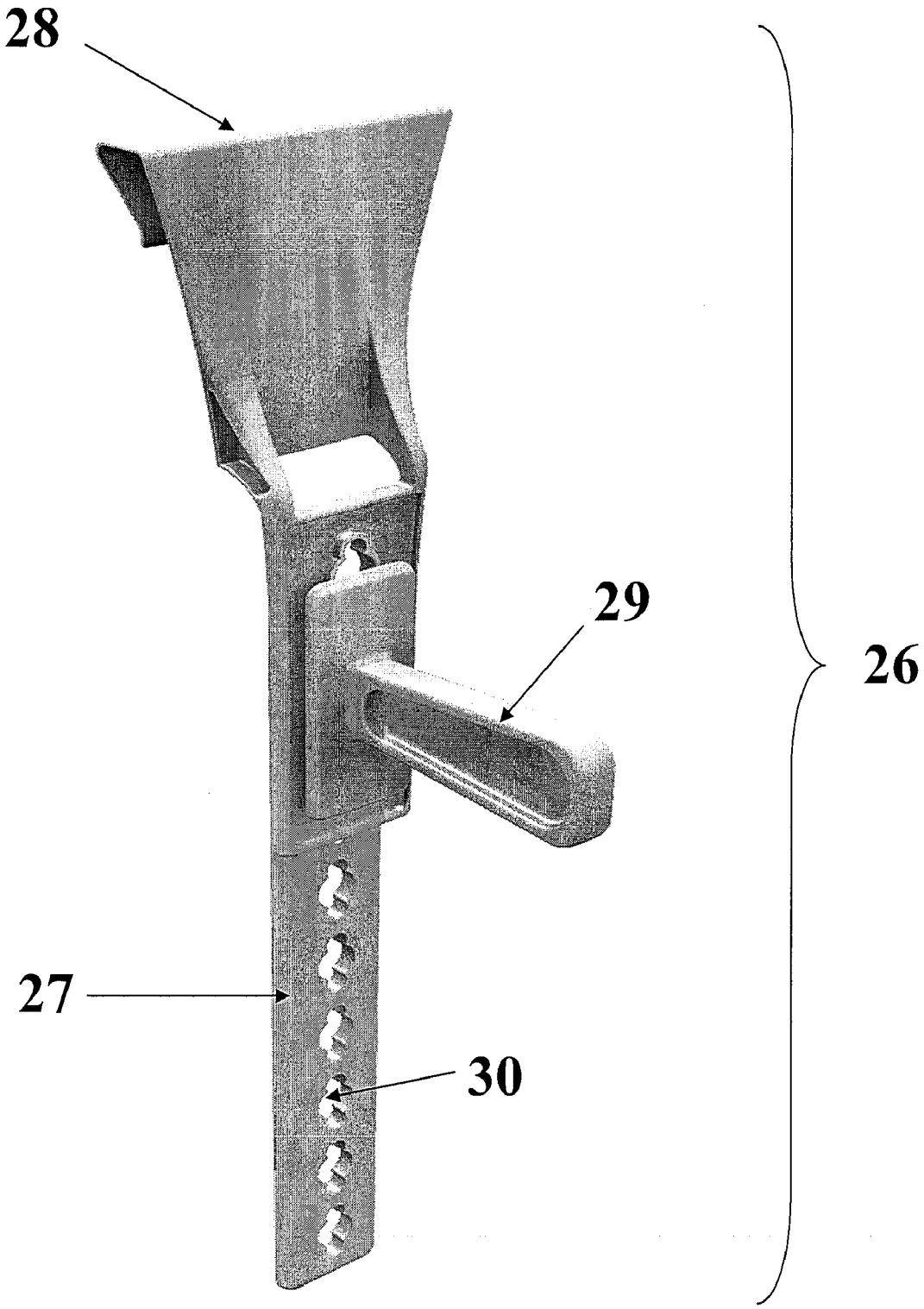
FIG. 12 is a perspective view of another embodiment of the device of the present invention.

FIG. 12 shows another embodiment of the device of the present invention. storage rack 26 includes support frame 27 having a hook 28 for mounting the device to a toilet tank, and at least one peg 29 for holding and storing a youth potty seat. Keyhole apertures 30 are included in support frame 27 to facilitate attachment of pegs 29. The dimensions of hook portion 28 are such as to allow attachment to a toilet tank while the tank lid is properly in place. For example, hook portion 28 preferably has a thickness of about 2 mm.

Figure 13:
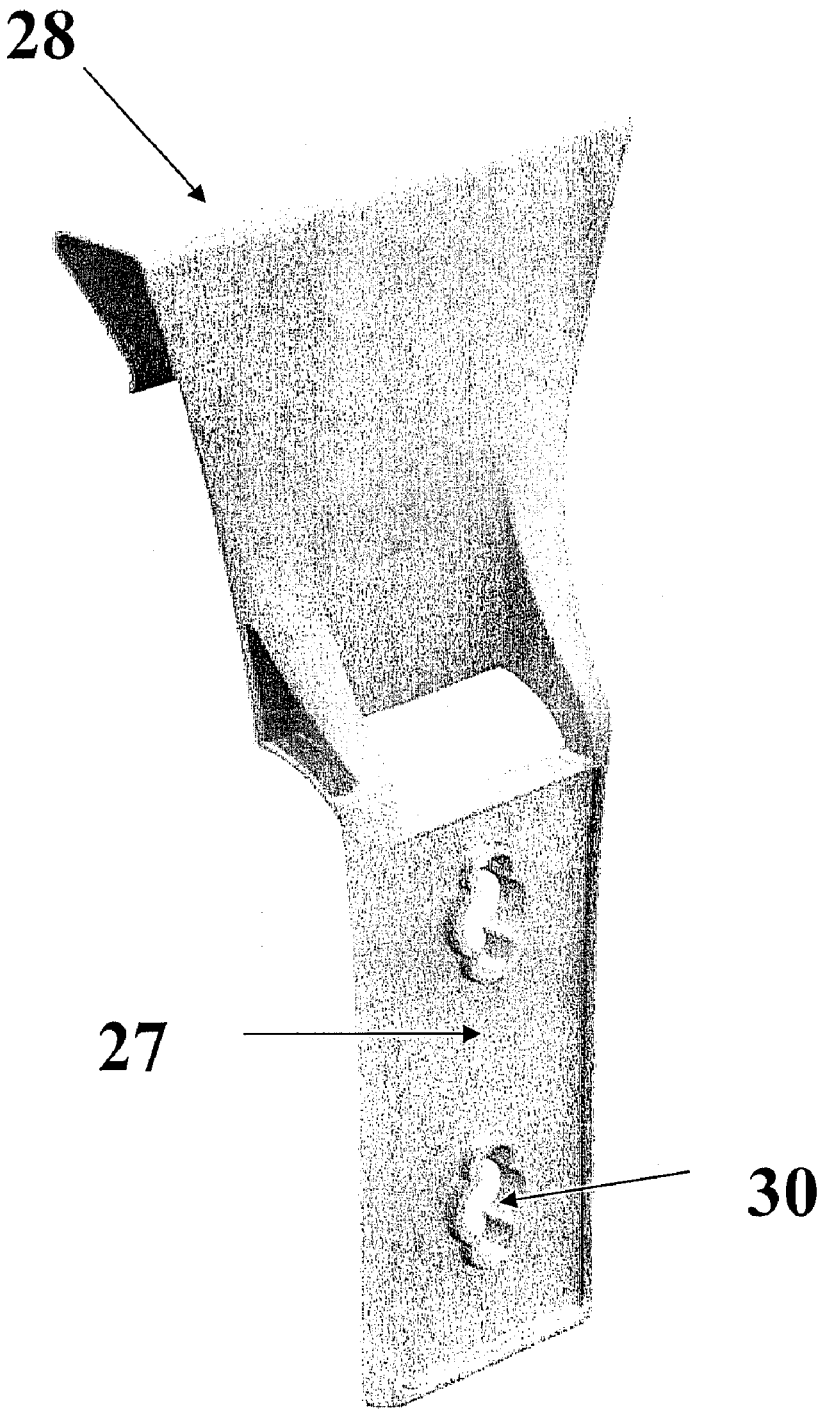
FIG. 13 is a perspective view of the support frame and toilet tank hook of another embodiment of the device of the present invention

FIG. 13 shows another embodiment of a support frame 27 with hook portion 28 and keyhole apertures 30.

Figure 14A:
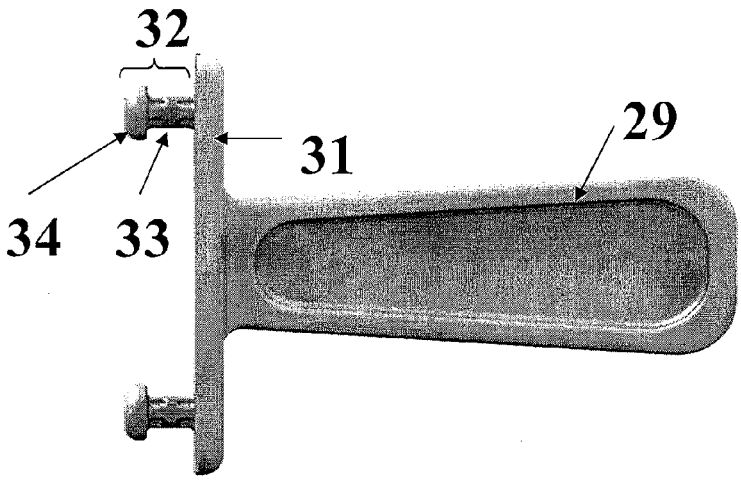
FIGS. 14A and 14B are side and perspective views, respectively, of the potty hanging peg of one embodiment of the device of the present invention.
Figure 14B:
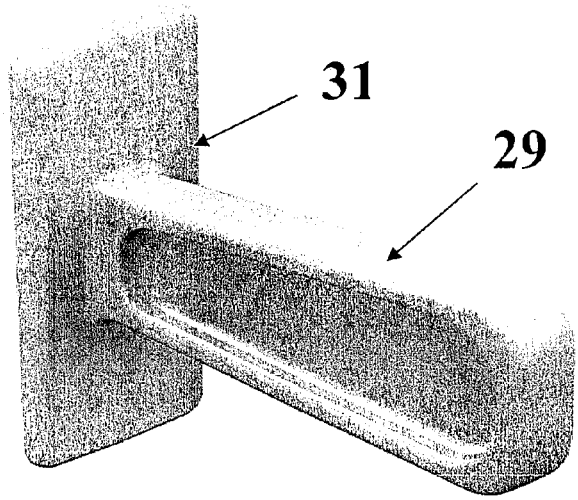

FIGS. 14A and 14B show embodiments of a peg assembly, including peg portion 29 and peg back 31. Peg studs 32 may be provided on peg back 31, with peg studs 32 preferably including peg stud shank 33 and peg stud head 34. Peg stud shank 33 and peg stud head 34 are sized to cooperate with keyhole apertures 30 to allow peg assembly 29 to lockably attach to support frame 27. The lockable attachment is a friction fit that engages when peg stud shank 33 is snapped into keyhole aperture 30.

Figure 15:
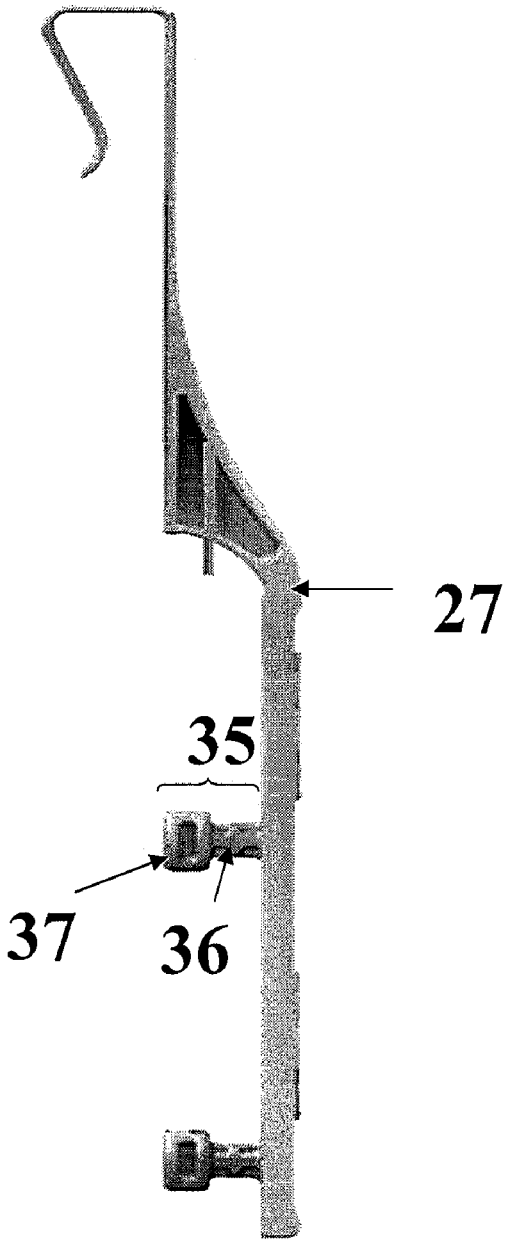
FIG. 15 is a side view of the support frame and toilet tank hook of FOG. 13.

FIG. 15 shows another embodiment of the device of the present invention, with support studs 35 being provided on the back of support frame 27. Support studs 35 include support stud shanks 36 and support stud heads 37.

Figure 16:
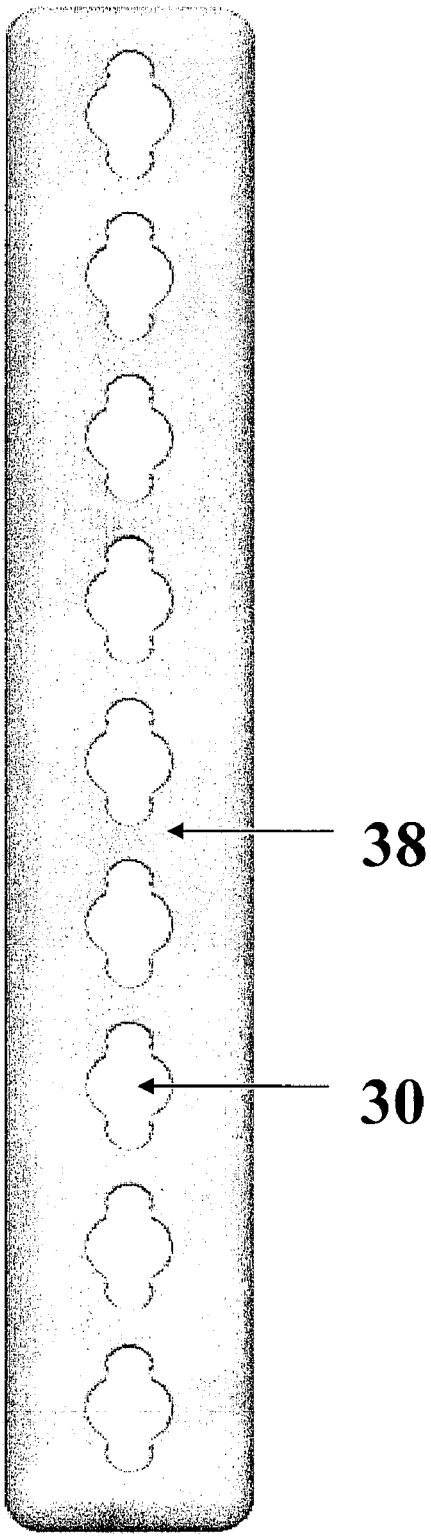
FIG. 16 is a front view of one embodiment of an extension bar that may be used in some embodiments of the present invention.
Figure 17:
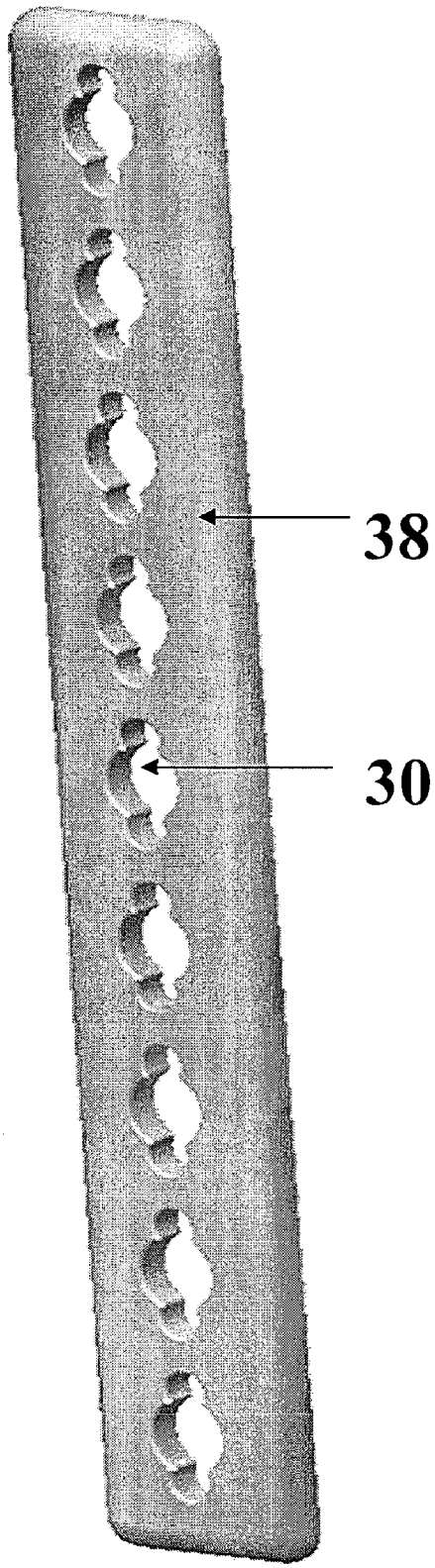
FIG. 17 is a perspective view of the extension bar of FIG. 16.

FIGS. 16 and 17 show one embodiment of an extension bar 38 that may be provided to extend the useful length of support frame 27. Extension bar 38 may attach to support frame 27 by support studs 35, and pegs 29 may correspondingly attach to extension bar 38.

Figure 18:
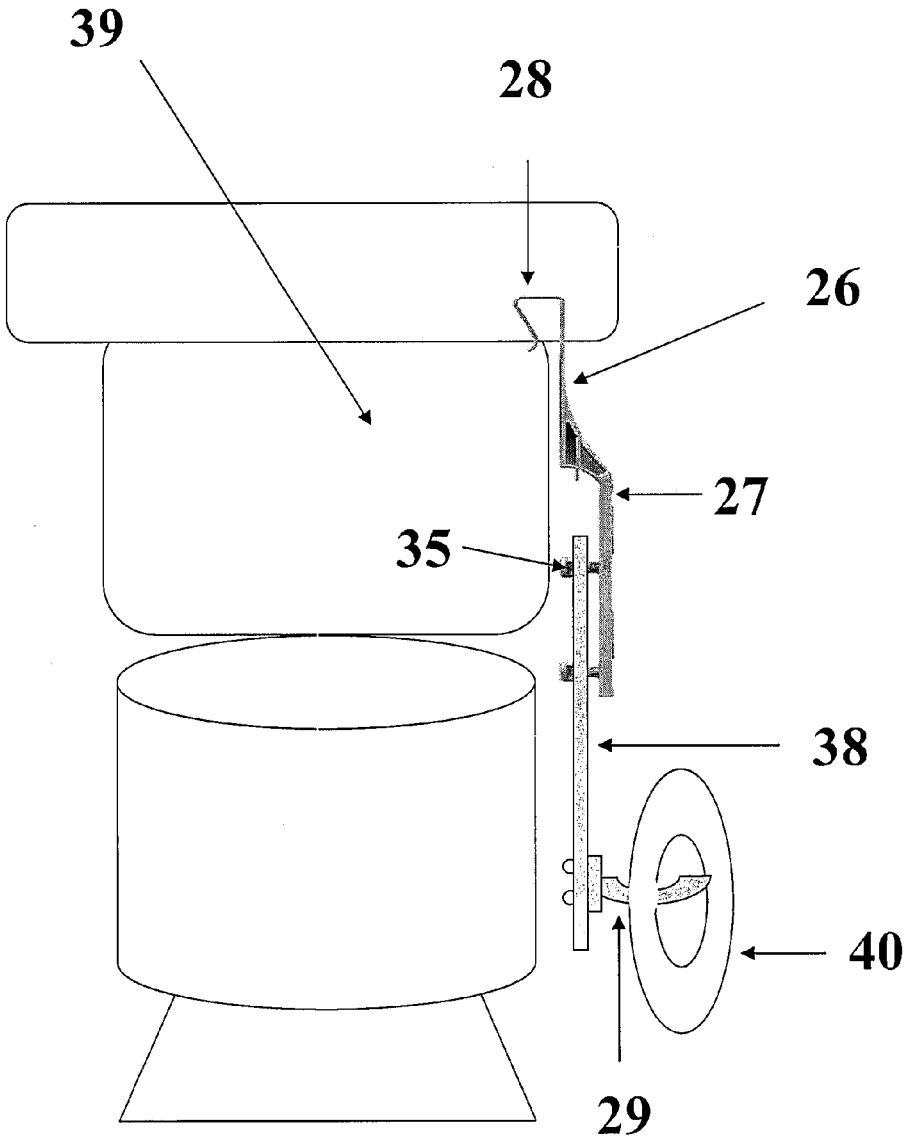
FIG. 18 is a perspective view of one embodiment of the present invention, with the device hanging from a toilet tank and storing a potty seat.

FIG. 18 shows one embodiment of the device of the present invention in use. Storage rack 26 is attached to toilet tank 39 by hook portion 28 on support frame 27. Extension bar 38 extends the length of support frame 27. Peg 29 is attached to support frame 27 as described above, and holds a youth potty seat 40.

Figure 19:
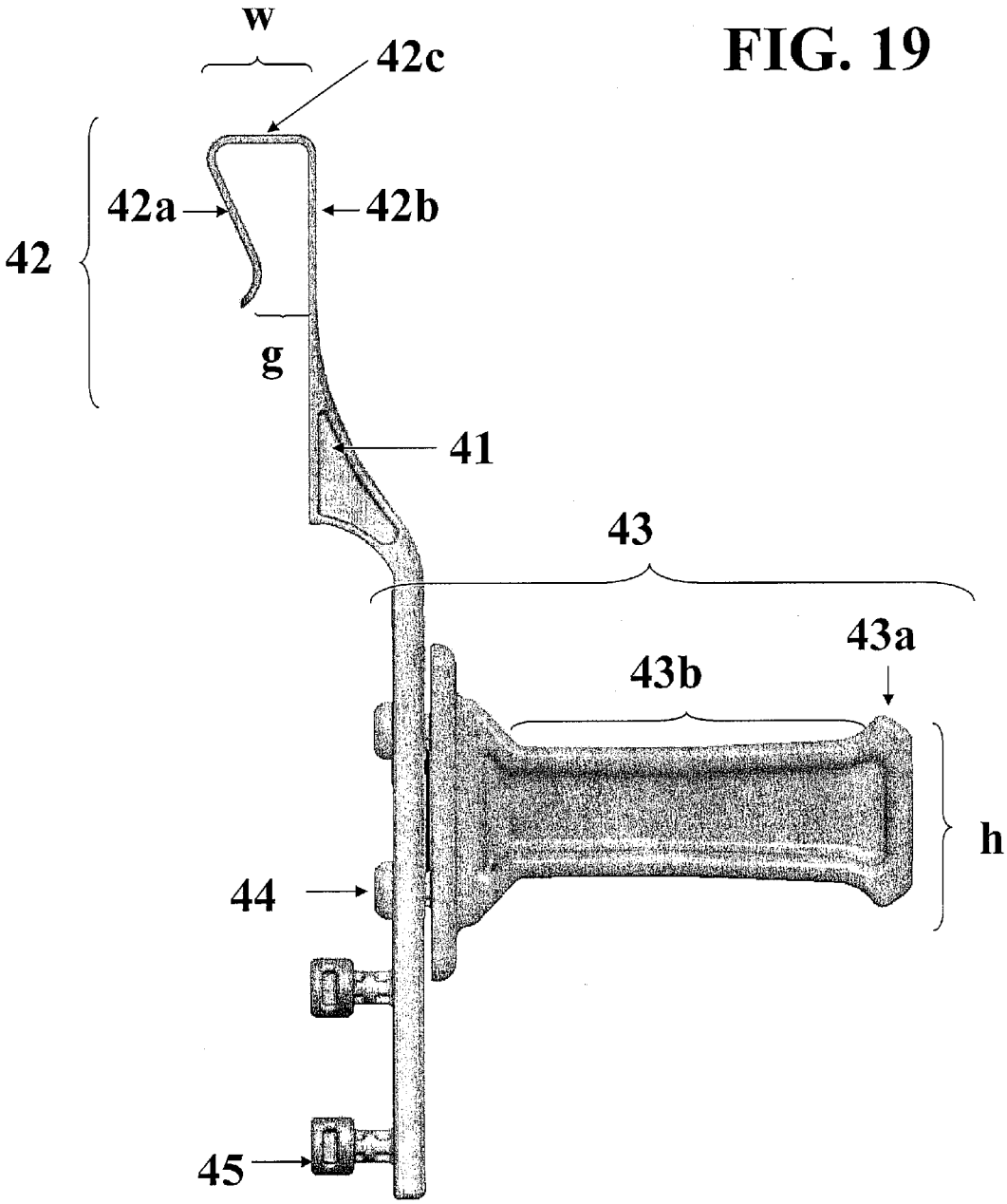
FIG. 19 shows another embodiment of the device of the present invention.

FIG. 19 shows another embodiment of the device of the present invention, showing support frame 41 with hook 42 at one end to facilitate attachment to a toilet tank. Peg 43 is attached by peg studs 44, and additional support studs 45 are provided to extend the device by an extension bar if desired.

In the embodiment illustrated in FIG. 19, peg 43 is sized and adapted to securely hold a youth potty seat, as illustrated in FIG. 18. Peg 43 may therefore include a sturdy potty seat-contacting portion 43*b* which may be flat or curved and is preferably between about 2" and 4" long. Peg 43 may also include an upturned front portion 43*a* to keep the potty seat from falling from the peg. The height "h" of peg 43 is preferably between 1" and 1.5" to allow other object such as a roll of toilet paper to be hung from the peg.

In the embodiment illustrated in FIG. 19, hook 42 is sized and adapted to fit snugly over the rim of a toilet tank to facilitate firm and secure placement of the device to the tank. Hook 42 therefore includes a rearward arm 42*a* that may be biased inward toward forward arm 42*b* to press against the tank wall with t pressure fit. The gap "g" between forward arm 42*b* and rearward arm 42*a* is preferably between about ⅛" and ½", most preferably about ¼". The width "w" of hook 42 may be wider than the width of support bar 41, with support bar 41 preferably being between 1" and 2" (most preferably about 1.5") wide and hook 42 preferably being between 2" and 3" (most preferably about 2.5") wide.

Figure 20:
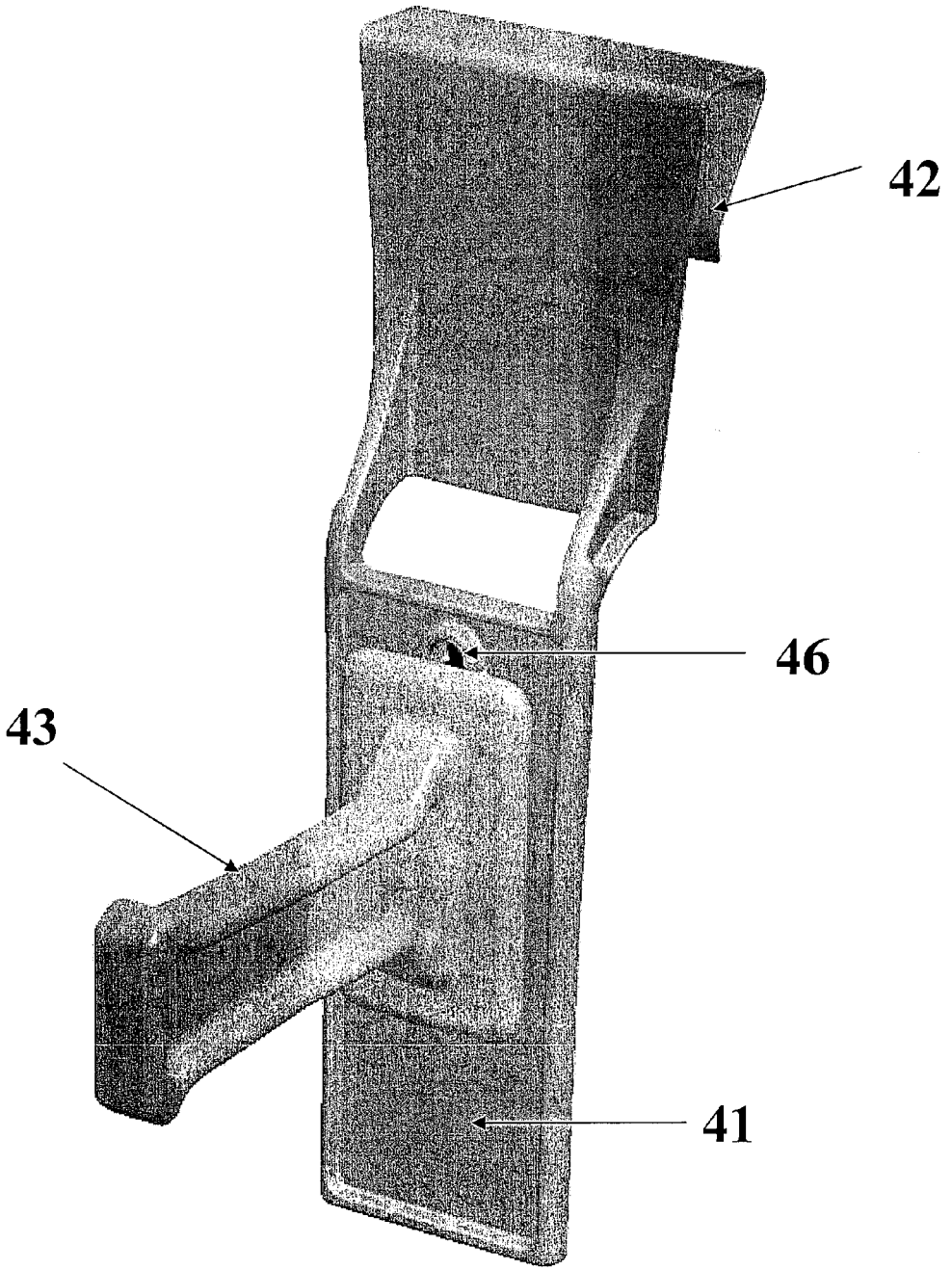
FIG. 20 shows another view of the device of FIG. 19.

FIG. 20 shows another view of the device of FIG. 19. Peg 43 is attached through keyhole apertures 46.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method of storing a youth potty seat on an adult toilet assembly, the method comprising:

a) providing a storage rack adapted to hold at least one youth potty seat, wherein said storage rack includes:

i) a support frame having an upper end and a lower end, said support frame including a plurality of support studs effective for holding an extender bar;

ii) a hook connected to the support frame, wherein said hook is effective for hanging the support frame from the upper rim of a toilet tank;

iii) an extender bar having a plurality of apertures effective for receiving said support frame support studs and further effective for receiving potty seat peg studs to adjustably hold potty seat a peg in selected members of said plurality of apertures; and iv) at least one potty seat peg adjustably attachable to the extender bar and effective for holding a youth potty seat, wherein said potty seat peg includes one or more peg studs effective for holding said potty seat peg in the apertures of said extender bar;

wherein the support frame is positioned forward of said hook and is separated from the hook by a gap sized to allow said extender bar to extend therethrough;

wherein said storage rack is adaptable to a first position wherein said extender bar extends downward below said support frame without passing through said gap; and wherein said storage rack is adaptable to a second position wherein said extender bar extends upward above said support frame and passes through said gap;

b) selecting to assemble said storage rack in either its first position wherein said extender bar extends downward below said support frame without passing through said gap, or its second position wherein said extender bar extends upward above said support frame and passes through said gap;

c) connecting said extender bar to said support frame in its selected position by snapping one or more of said support frame support studs into apertures in said extender bar, wherein said extender bar is positioned in either its first position wherein said extender bar extends downward below said support frame without passing through said gap, or its second position wherein said extender bar extends upward above said support frame and passes through said gap;

d) connecting said potty seat peg to said support frame by snapping one or more of said potty seat studs into apertures in said extender bar;

e) hanging said storage rack from an adult toilet assembly by hanging the hook of the storage rack from the upper rim of a toilet tank; and f) hanging a youth potty seat on the potty seat peg of the storage rack; thereby storing the youth potty seat on the adult toilet assembly.

2. The method of claim 1 wherein said extender bar apertures comprise more keyhole apertures for adjustably positioning said at least one potty seat peg on the extender bar, and wherein said potty seat connecting step includes connecting said potty seat peg to said extender bar by snapping one or more of said potty seat studs into keyhole apertures in said extender bar.

3. The method of claim 1 wherein said hook is sized and adapted to fit snugly over the rim of a toilet tank to facilitate firm and secure placement of the device to the tank, and wherein said hanging step includes hanging the hook of the storage rack from the upper rim of a toilet tank with said hook fitting snugly over the rim of a toilet tank.

4. The method of claim 3 wherein said hook includes a rearward arm that is biased inward toward a forward arm to press against the tank wall with a pressure fit, and wherein said hanging step includes hanging the hook of the storage rack from the upper rim of a toilet tank so that said forward arm presses against the tank wall with a pressure fit.

5. The method of claim 4 wherein a gap of about ¼" is provided between said rearward arm and said forward arm, and wherein said hanging step includes hanging the hook of the storage rack from the upper rim of a toilet tank so that said gap of about ¼" receives the upper rim of said toilet tank.

* * * * *